US011639794B2

(12) United States Patent
Gonzalez

(10) Patent No.: US 11,639,794 B2
(45) Date of Patent: May 2, 2023

(54) FLUID FLOW FITTING FOR COMBUSTIBLE FLUIDS

(71) Applicant: NOVA-TEK LLC, Midland, TX (US)

(72) Inventor: Victor Gonzalez, Midland, TX (US)

(73) Assignee: Victor Gonzalez, Midland, TX (US)

( * ) Notice: Subject to any disclaimer, the term of this patent is extended or adjusted under 35 U.S.C. 154(b) by 200 days.

(21) Appl. No.: 16/736,012

(22) Filed: Jan. 7, 2020

(65) Prior Publication Data

US 2021/0207801 A1 Jul. 8, 2021

(51) Int. Cl.
*F23G 7/08* (2006.01)
*F23D 14/24* (2006.01)

(52) U.S. Cl.
CPC ..... *F23G 7/085* (2013.01); *F23D 14/24* (2013.01)

(58) Field of Classification Search
CPC ..... F23G 7/085
See application file for complete search history.

(56) References Cited

U.S. PATENT DOCUMENTS 4,003,693 A * 1/1977 Straitz, III ..... F23G 7/085 431/202
11,029,026 B2 6/2021 Chambers et al.
2020/0309368 A1* 10/2020 Chambers ..... F23N 1/027

* cited by examiner

*Primary Examiner* — Jason Lau
(74) *Attorney, Agent, or Firm* — Kearney, McWilliams & Davis; Dileep P. Rao

(57) ABSTRACT

A fluid flow fitting with a tubular comprising a void therethrough allowing flow of a fluid, a plurality of fins at least partially transverse to the flow of the fluid extending inward from an inner wall of the tubular, and an outlet cap having an outlet hole centered thereon. An ignition source can be placed proximate the outlet cap and/or outlet hole to ignite the combustible fluid. The fins can cause a swirling motion of the combustible fluid, thereby separating contaminants from the combustible fluid and leading to more efficient and clean combustion.

12 Claims, 2 Drawing Sheets

FIGURE 1A
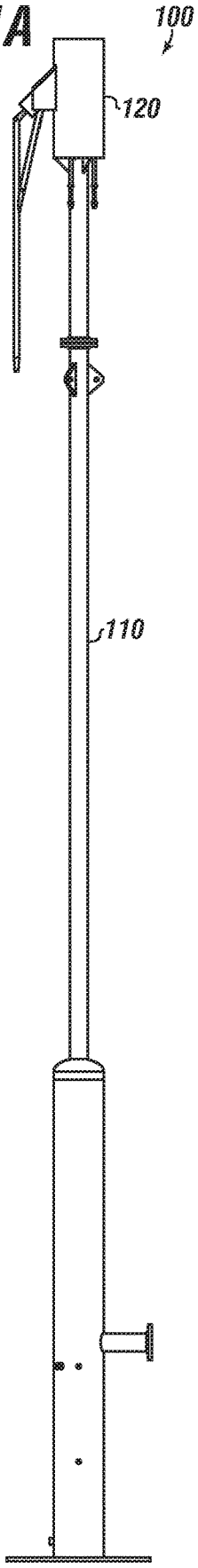
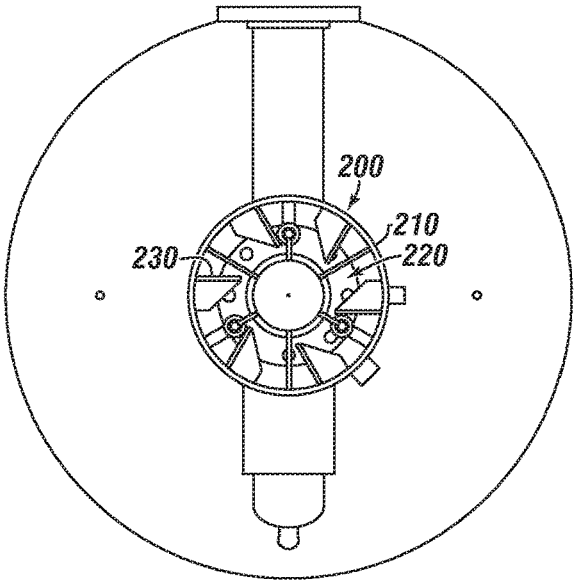
FIGURE 1B
FIGURE 1C
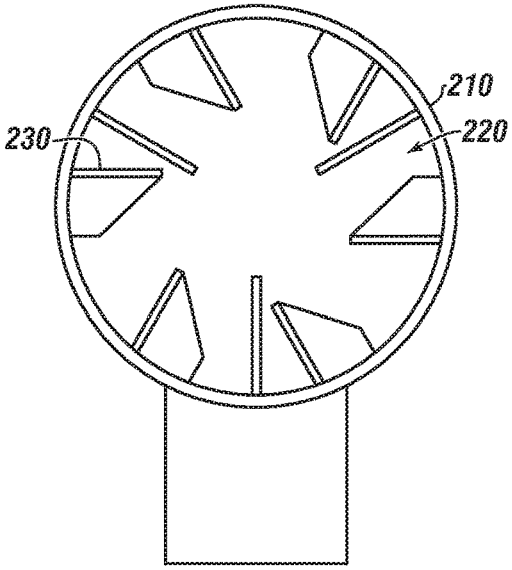

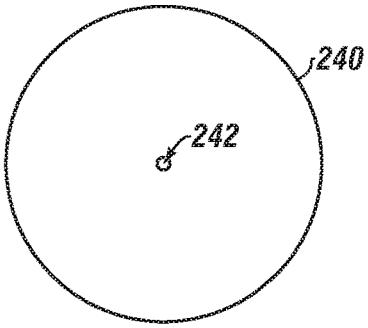
FIGURE 2A
FIGURE 2B
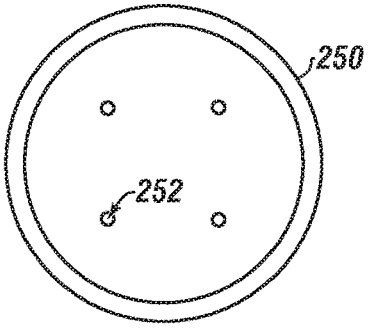
FIGURE 3
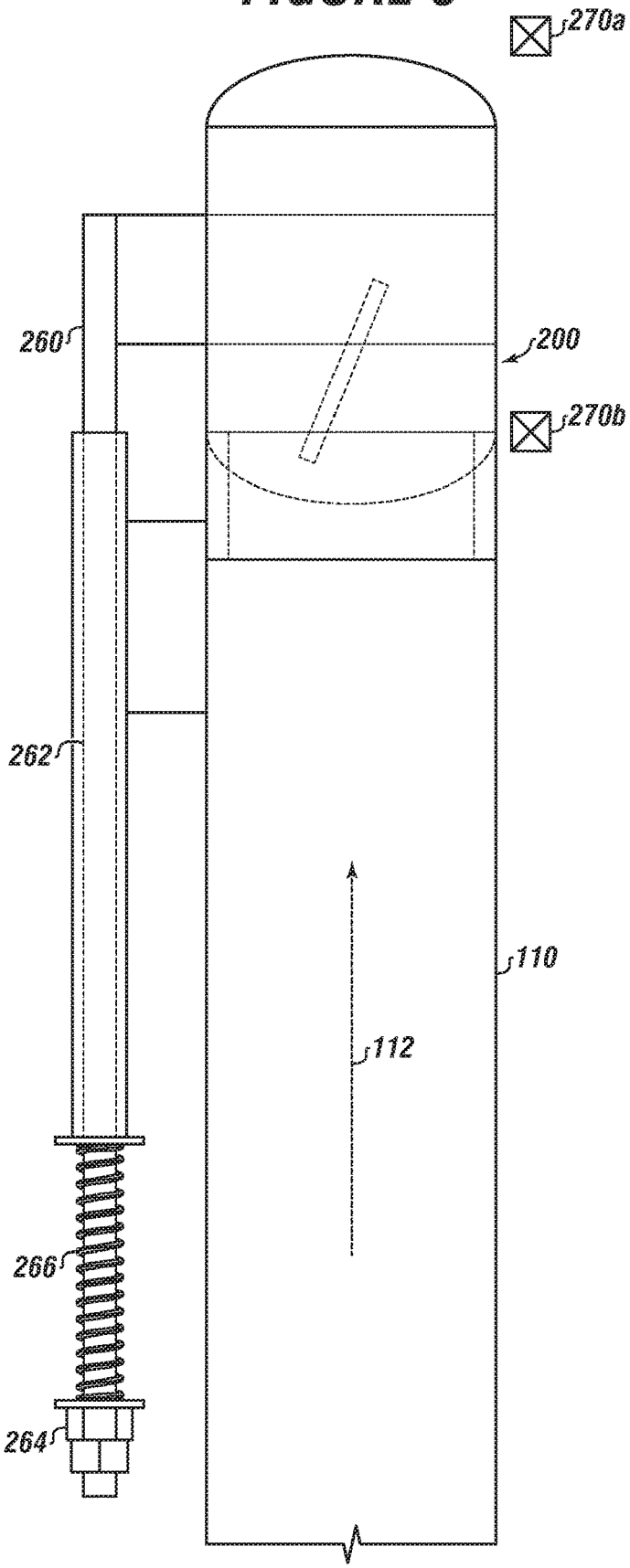

FLUID FLOW FITTING FOR COMBUSTIBLE FLUIDS

FIELD

The present disclosure generally relates to a fluid flow fitting for combustible fluids.

BACKGROUND

Combustible fluids are delivered to an ignition source in many ways. Typical means may include a simple flow of fluid, such as in a gas range, an injection of fluid, such as the fuel injectors of a car, and the like.

In many instances, there may be impurities in the fluid that reduce the efficiency of the fluid's combustion. It is desirable, therefore, to have a fluid flow fitting that separates impurities from the fluid and makes combustion more efficient.

While many applications exist for such a fitting, gas flaring is a common method of combusting unwanted or excess gases and/or liquids either as a means of disposal, or as a safety measure, such as to relieve pressure.

Fluid products can be released during normal or unplanned operation in many industrial processes, such as oil-gas extraction, refineries, chemical plants, the coal industry, or landfills.

In flaring operations, combustible gasses may often have impurities or non-combustible elements. The impurities or non-combustible elements are commonly heavier than the combustible fluid.

It is desirable, therefore, to separate the impurities from the combustible fluid to enable more complete combustion of the fluid.

The present invention meets these needs.

BRIEF DESCRIPTION OF THE DRAWINGS

The detailed description will be better understood in conjunction with the accompanying drawings as follows:

FIG. 1A depicts an embodiment of a flare stack of the present disclosure.

FIG. 1B is a top cut view of the flare stack of FIG. 1A.

FIG. 1C is a top cut view of the fitting of FIG. 1B.

FIG. 2A is an embodiment of an outlet cap of the present disclosure.

FIG. 2B is an embodiment of an inlet cap of the present disclosure.

FIG. 3 is a side view of a flare stack of the present disclosure.

The embodiments of the present disclosure are detailed below with reference to the listed Figures.

DETAILED DESCRIPTION OF THE EMBODIMENTS

Before explaining the present disclosure in detail, it is to be understood that the disclosure is not limited to the specifics of particular embodiments as described and that it can be practiced, constructed, or carried out in various ways.

While embodiments of the disclosure have been shown and described, modifications thereof can be made by one skilled in the art without departing from the spirit and teachings of the disclosure. The embodiments described herein are exemplary only, and are not intended to be limiting.

Specific structural and functional details disclosed herein are not to be interpreted as limiting, but merely as a basis of the claims and as a representative basis for teaching persons having ordinary skill in the art to variously employ the present embodiments. Many variations and modifications of embodiments disclosed herein are possible and are within the scope of the present disclosure.

Where numerical ranges or limitations are expressly stated, such express ranges or limitations should be understood to include iterative ranges or limitations of like magnitude falling within the expressly stated ranges or limitations.

The use of the word "a" or "an" when used in conjunction with the term "comprising" in the claims and/or the specification may mean "one," but it is also consistent with the meaning of "one or more," "at least one," and "one or more than one."

The word "about" means plus or minus 5% of the stated number.

The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

When methods are disclosed or discussed, the order of the steps is not intended to be limiting, but merely exemplary unless otherwise stated.

Accordingly, the scope of protection is not limited by the description herein, but is only limited by the claims which follow, encompassing all equivalents of the subject matter of the claims. Each and every claim is hereby incorporated into the specification as an embodiment of the present disclosure. Thus, the claims are a further description and are an addition to the embodiments of the present disclosure.

The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

The embodiments of the present disclosure generally relate to a fluid flow fitting for combustible fluids. A fluid can mean a gas or a liquid for the purposes of this disclosure.

A fluid flow fitting comprising a tubular comprising a void therethrough allowing flow of a fluid, a plurality of fins extending inward from an inner wall of the tubular, wherein a portion of each fin is at least partially transverse to the flow of the fluid, and an outlet cap having an outlet hole centered thereon. An ignition source can be placed proximate the outlet cap and/or outlet hole to ignite the combustible fluid.

In embodiments, the fitting can also have an inlet cap having at least one inlet hole, wherein each inlet hole is radially offset from a center of the inlet cap. The inlet hole(s) can be offset from the center and positioned to align fluid flow with the fins within the tubular.

In embodiments, the fitting can be displaceable in the direction of fluid flow, or opposite the direction of fluid flow. For example, if the inlet holes are not able to allow all fluid into the fitting, the fitting can be displaced to allow for flow around the fitting. When the fitting is displaceable, the fitting can have a guide hole, a guide rod, and a stop to restrict the movement of the fitting. An ignition source can be provided proximate the inlet cap for igniting fluid that is flowing around the fitting. The fitting can further be biased in a direction opposite the outlet cap to provide back pressure to the fluid.

In embodiments, each fin can be helically curved with respect to the flow of the fluid.

In flare embodiments, a bonnet covering the fitting can be installed to contain and/or direct the flame when fluid is combusted.

The fitting allows for off centered inlet flow of fluid, directing fluid flow to the fins extending inward from the tubular inner wall. The fins, being at least partially transverse to the fluid cause a swirling motion to occur within the void of the tubular. This swirling or vortexing of the fluid causes heavier elements to be separated radially outward. These heavier elements can include condensate water, or hydrocarbons heavier than the desired combustible fluid, which can inhibit combustion to some degree.

Turning now to the Figures, FIG. 1A depicts an embodiment of a flare stack of the present disclosure.

Shown here is flare stack 100 with pipe 110 and bonnet 120.

FIG. 1B is a top cut view of the flare stack of FIG. 1A.

Shown here is fitting 200. Fitting 200 can have a tubular 210 comprising a void 220. Fin 230 can extend from an inner wall of the tubular into the void.

FIG. 1C is a top cut view of the fitting of FIG. 1B.

Shown here is tubular 210 comprising a void 220. Fin 230 can extend from an inner wall of the tubular into the void. Fin 230 can be linear (as shown) and placed at an angle transverse to direction of fluid flow. In other embodiments, the fin 230 can be helically curved either longitudinally with respect to fluid flow, or transversely with respect to fluid flow. Helical curvature can be implemented as desired by persons having ordinary skill in the art to control or enhance vortexing of the fluid as desired.

FIG. 2A is an embodiment of an outlet cap of the present disclosure.

Shown here is outlet cap 240 with outlet hole 242. While generally desirable to place outlet hole 242 in the center of the outlet cap 240, persons having ordinary skill in the art can adjust the size of outlet hole 242, and/or provide multiple outlet holes at various radial displacements from center. In embodiments, the outlet hole 242 can be configured to atomize liquids as they exit.

FIG. 2B is an embodiment of an inlet cap of the present disclosure.

Shown here is inlet cap 250 with various inlet holes 252. The inlet holes 252 are generally offset from the center to direct fluid toward the fins. However, the exact radial displacement from the center and number of inlet holes can be determined by persons having ordinary skill in the art based upon the specific application.

FIG. 3 is a side view of a flare stack embodiment of the present disclosure.

Shown here is fitting 200 resting atop pipe 110. Combustible fluid 112 is flowing in pipe 110. The fitting 200 can be in mechanical communication with a guide rod 260, a guide hole 262, and a stop 264 to prevent the fitting 200 from falling from the pipe 110. Combustible fluid 112 flows into the fitting 200. In situations where the flow is too high for the fitting 200 to handle, the fitting 200 can lift off the pipe 110, allowing excess fluid to flow around the fitting. Ignition sources 270*a* and/or 270*b* can be provided to ignite the combustible fluid 112.

A bias 266 can be included to provide additional back pressure (as shown) to the combustible fluid 112. In other embodiments, the bias can be directed in the opposite direction to allow for assisted lift of the fitting 200.

While the present disclosure emphasizes the embodiments, it should be understood that within the scope of the appended claims, the invention might be practiced other than as specifically described herein.

What is claimed is:

1. A fluid flow fitting comprising:

a) a tubular comprising a void therethrough allowing flow of a fluid;

b) a plurality of fins adapted to induce vortexing extending inward from an inner wall of the tubular, wherein a portion of each fin is at least partially transverse to the flow of the fluid;

c) an outlet cap having an outlet hole centered thereon; and d) an inlet cap opposite the outlet cap having at least one inlet hole, wherein the at least one inlet hole is radially offset from a center of the inlet cap; and wherein the fluid flow fitting is attached to a pipe and is displaceable during operation with respect to the pipe in the direction of fluid flow, or opposite the direction of fluid flow.

2. The fitting of claim 1, wherein the inlet cap comprises a plurality of inlet holes, wherein each inlet hole is radially offset from a center of the inlet cap.

3. The fitting of claim 1, further comprising a guide hole, a guide rod, and a stop.

4. The fitting of claim 1, further comprising an ignition source proximate and external to the outlet cap.

5. The fitting of claim 2, further comprising an ignition source proximate the inlet cap.

6. The fitting of claim 3, further comprising a bias, wherein the fluid flow fitting is biased in a direction parallel to fluid flow.

7. The fitting of claim 2, further comprising a guide hole, a guide rod, and a stop.

8. The fitting of claim 6, further comprising a bonnet covering the fluid flow fitting.

9. The fitting of claim 2, further comprising a bias, wherein the fluid flow fitting is biased with respect to the pipe in a direction parallel to fluid flow.

10. The fitting of claim 9, further comprising a bonnet covering the fluid flow fitting.

11. A fluid flow fitting comprising:

a) a tubular comprising a void therethrough allowing flow of a fluid;

b) a plurality of fins adapted to induce vortexing extending inward from an inner wall of the tubular, wherein a portion of each fin is at least partially transverse to the flow of the fluid;

c) an outlet cap having an outlet hole centered thereon; and d) an inlet cap opposite the outlet cap having at least one inlet hole, wherein each inlet hole is radially offset from a center of the inlet cap; and wherein the fluid flow fitting is attached to a pipe and is displaceable during operation with respect to the pipe in the direction of fluid flow, or opposite the direction of fluid flow.

12. The fitting of claim 11, further comprising a bias attached to the pipe, wherein the fluid flow fitting is biased in a direction parallel to fluid flow.

* * * * *